US005105949A

United States Patent [19]

Blair

[11] Patent Number: 5,105,949

[45] Date of Patent: Apr. 21, 1992

[54] MEDICINE AND RECORD HOLDER

[76] Inventor: Paul A. Blair, 3621 NW. 23rd St., Lauderdale Lakes, Fla. 33311

[21] Appl. No.: 598,963

[22] Filed: Oct. 17, 1990

[51] Int. Cl.[5] ..... B65D 83/04

[52] U.S. Cl. ..... 206/534; 206/528; 206/536; 206/537; 206/538

[58] Field of Search ..... 206/459, 528, 534, 536, 206/537, 538, 539, 540, 38, 371, 470

[56] References Cited

U.S. PATENT DOCUMENTS

| | | | |
|---|---|---|---|
| 3,111,220 | 11/1963 | Bostrom | 206/470 |
| 3,579,883 | 5/1971 | Hayes | 206/534 |
| 4,308,951 | 1/1982 | Walker, Jr. | 206/371 |
| 4,739,883 | 4/1988 | Mohs et al. | 206/470 |
| 4,889,238 | 12/1989 | Batchelor | 206/534 |
| 4,955,481 | 9/1990 | Novinski et al. | 206/534 |
| 4,974,729 | 12/1990 | Steinnagel | 206/534 |

FOREIGN PATENT DOCUMENTS

| | | | |
|---|---|---|---|
| 3832083 | 3/1990 | Fed. Rep. of Germany | 206/470 |

*Primary Examiner*—David T. Fidei
*Attorney, Agent, or Firm*—Alvin S. Blum

[57] ABSTRACT

A holder for pills has at least two separate compartments. The holder also holds a medicine record card for written medical information such as identification of patient medicine, dosage and the like. The holder holds the record card inside transparent faces so that the written record is undisturbed. The record card is arranged for erasable marking with a marker. The holder includes a recess for holding the marker. A space is provided for also retaining a card such as a medical insurance or credit card that may be read without removing it from the holder.

9 Claims, 3 Drawing Sheets

MEDICINE AND RECORD HOLDER

BACKGROUND OF THE INVENTION

This invention relates to containers and more specifically to a device for containing a supply of emergency medication such as nitroglycerine which must be taken immediately to avoid life threatening conditions. The container includes a transparent holder for a written medical record of prescriptions and the like and may hold medical insurance cards as well.

Prescription medication is generally supplied in a container large enough to hold the entire supply of pills for which the prescription is written. The name of the patient, physician, and administration instructions are attached to the container.

Because it is awkward to carry about the entire container and may expose the supply to unfavorable environmental conditions, the user will carry a few of the pills or capsules around if necessary in a small pillbox. The small pillbox may be simple or ornate, but there are no provisions for attaching the necessary information related to the medication to the pillbox. When the patient is seen by a health care provider, a different physician, dentist, or emergency medical service worker, it is useful to have that information, especially if the patient is unable to provide it verbally. Additional pertinent medical information and health insurance information is also useful to have at hand, since lack of medical insurance evidence may deprive a patient of necessary care as often as lack of information of other medical conditions.

SUMMARY OF THE INVENTION

It is accordingly an object of the invention to provide means for securely containing small amounts of medication along with a writable and erasable record for recording pertinent medical information that is protected from accidental loss or erasure. It is another object to provide means for also containing therein information cards such as health insurance and credit cards and the like.

The medicine and record holder of the invention includes a container with at least one chamber for holding medicines,having a closure for retaining pills, capsules and the like. Attached to the container is a flat card holder that has transparent faces for viewing the card held between the faces. A card held within the card holder is adapted for receiving information written thereon. The card is adapted for repeated erasure of written material so that the medical information may be readily kept current as medical information of the user changes. A writing and erasing device adapted to operate with the card surface is also carried within the medicine and record holder so that the means for maintaining the current record is always at hand. A recess within the holder is also provided for holding cards such as medical insurance or credit cards in such a fashion as to not interfere with reading the medical information through the transparent sides. The transparent sides of the holder protect the written information from accidental erasure.

These and other objects, features and advantages of the invention will become more apparent when the following detailed description is considered in conjunction with the drawings.

DETAILED DESCRIPTION OF PREFERRED EMBODIMENT

Figure 4:
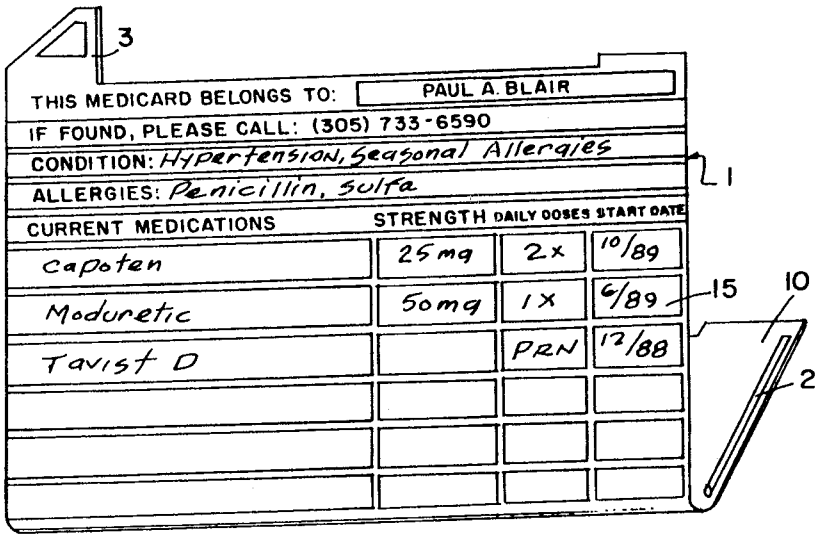
FIG. 4 is a perspective view of the information card.

Referring now first to FIG. 4, in folded plastic record card 1 has printed legends thereon and spaces upon which the user is to write in the appropriate information including, for example name, telephone number and current information on medication being used, dose, and medical conditions so that the information is always readily available. The card 1 has ridges 2 along its edges to provide a space between the two halves when folded flat. The space is a convenient place in which to carry one or more cards useful in a medical emergency such as a credit or a medical insurance card. A tab 3 on the record card is used as described below.

The plastic surface of card 1 is arranged for repeated writing and erasure. It may be a smooth plastic and the marker a dry marker of the type used for easy erasure on smooth plastic surfaces. Alternatively, the plastic surface may be rough, i.e. it may have a "tooth" in graphic art parlance for easy writing with a graphite pencil and the marker may be a graphite pencil.

Figure 1:
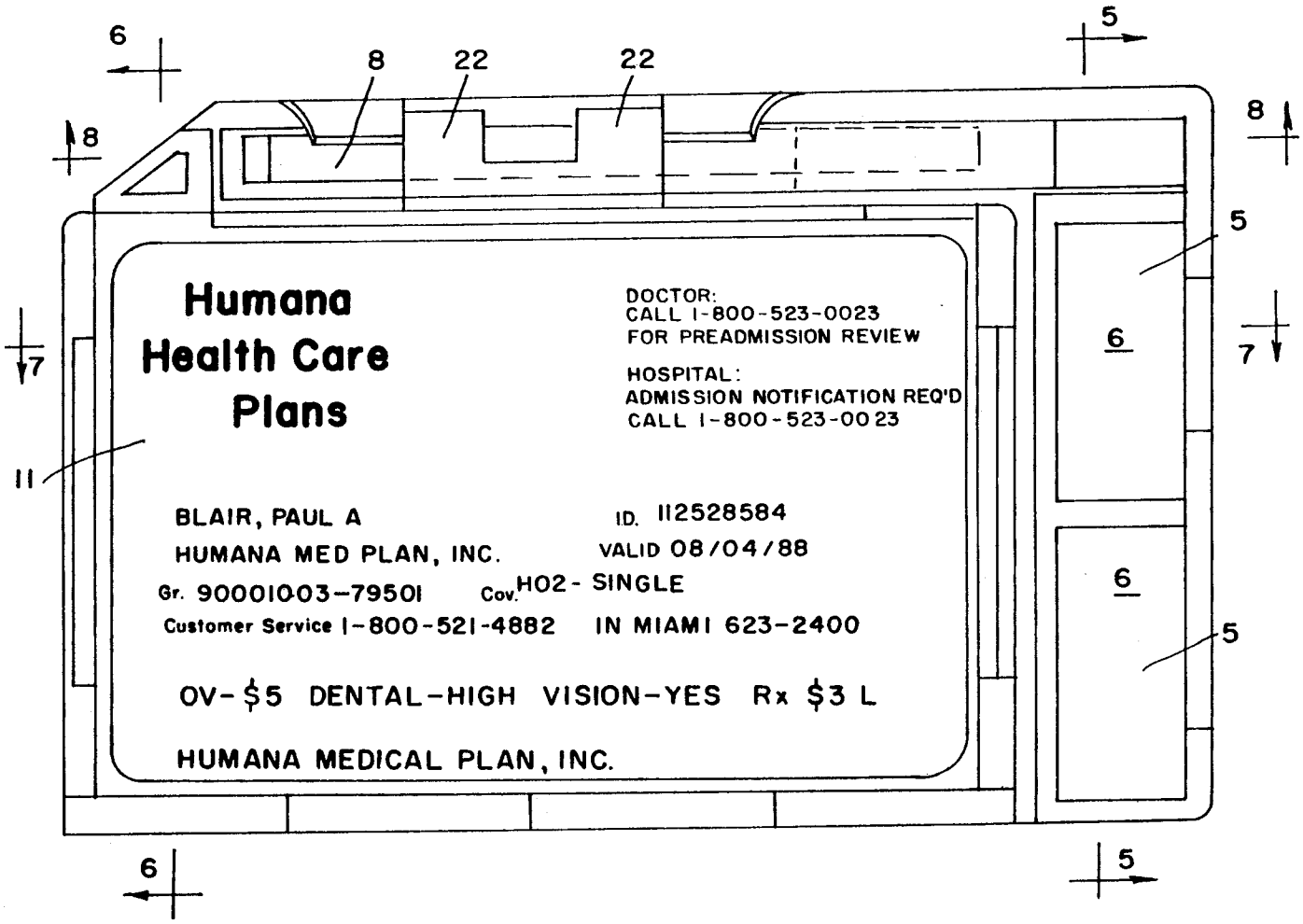
FIG. 1 is a plan view of the assembled holder.

The card 1 may be provided with a transparent portion 10 so that a medical insurance card 11 held between the two folded halves may be read without removing it as shown in FIG. 1. The portion 15 to receive writing is preferably opaque for enhanced readability.

Figure 3:
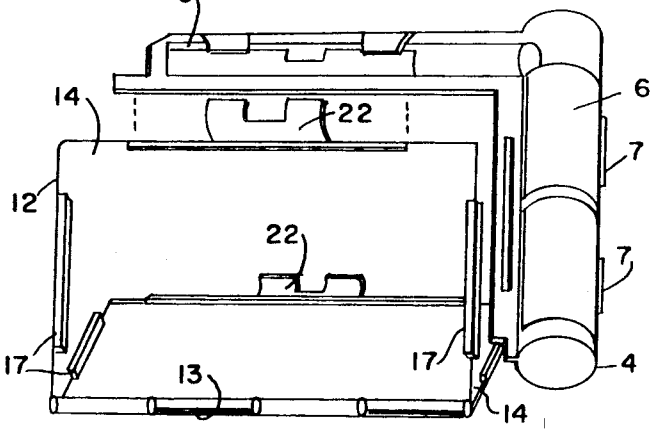
FIG. 3 is a perspective exploded view of the holder without the information card or marker.
Figure 2:
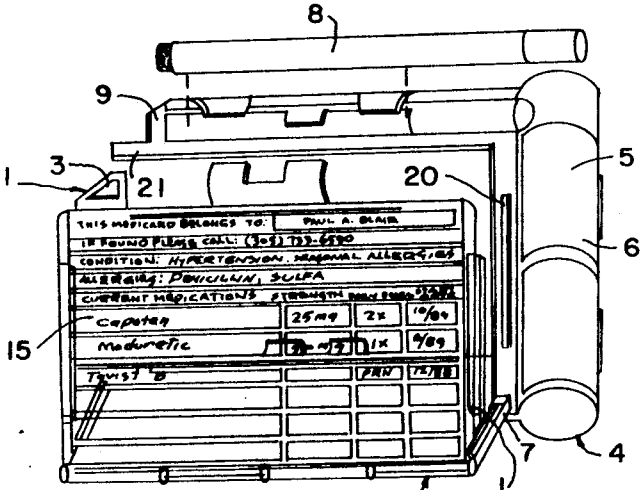
FIG. 2 is a perspective exploded view of the holder.
Figure 5:
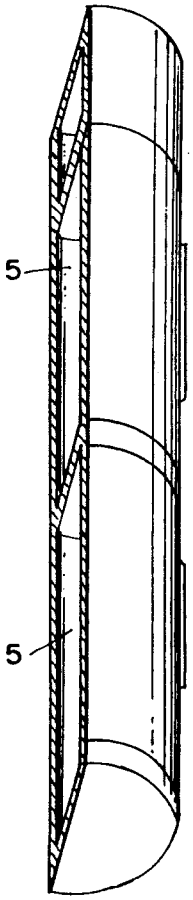
FIG. 5 is a perspective sectional view taken through 5—5 of FIG. 1.
Figure 8:
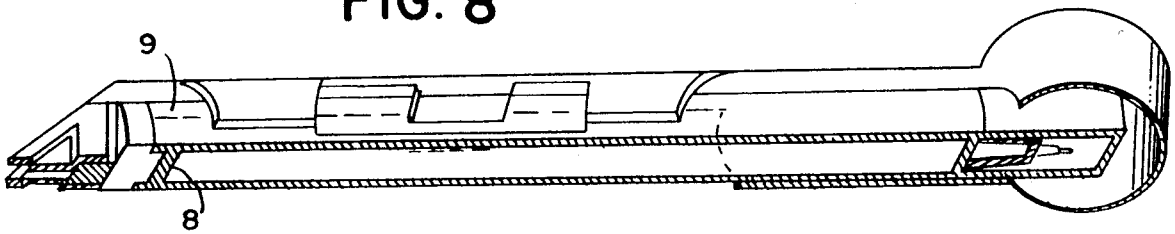
FIG. 8 is a perspective sectional view taken through 8—8 of FIG. 1.
Figure 7:
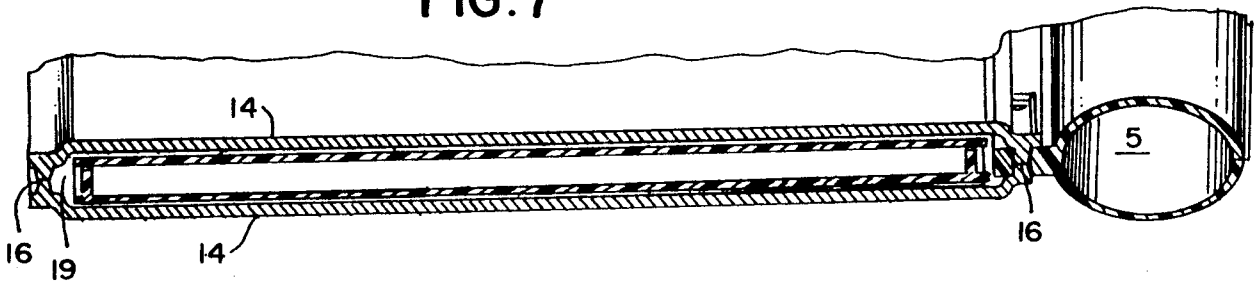
FIG. 7 is a perspective sectional view taken through 7—7 of FIG. 1.
Figure 6:
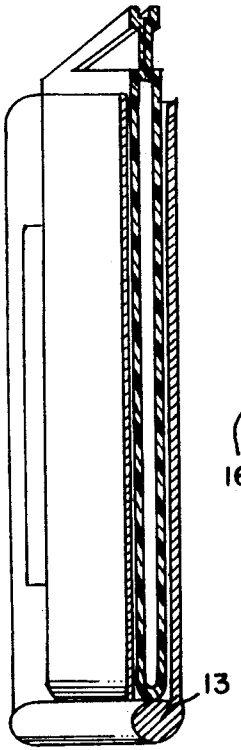
FIG. 6 is a perspective sectional view taken through 6—6 of FIG. 1.

Referring now to FIGS. 1-3, a pillbox or medicine holder 4 has two internal chambers 5 for holding two different medicines in the form of pills, capsules, and the like. A separate hinged door 6, held closed by latch 7 provides access to each chamber 5 in a manner well known in the art of plastic pillbox manufacture.

A marker 8 suitable for writing on card 1 is held in marker holder 9, attached to medicine holder 4.

A folding record holder 12 has two broad, flat, transparent faces 14 connected by hinge 13 along one side. Two sides 16 of holder 12 are formed by ridges 17 that hold the two broad faces 14 apart to define a space 19 for receiving the folded record card 1 therein. A slot 20 in the side of medicine holder 4 receives the two ridges 17 on one side of holder 4 to attach the two together.

The marker holder 9 has a bottom edge 21 that is held between the faces of the folded record holder 12 to form the fourth side of the record holder 12 to retain the record card. Arcuate projections 22 on holder 12 engage the marker holder, hold the assembly closed tight, and complete the enclosing of the marker.

The closed record holder 12 has a gap at its upper side through which tab 3 of record card 1 projects. This tab is easily grasped by infirm patients to use as a holder opener to pry apart the closed halves of the holder 12 when access is needed.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A combined medicine and record holder comprising: A) a medicine holder for medicines having a plurality of chambers with closure means for providing access to said chambers for storing and retrieving said medicines, each said chamber being provided with a separate, hinged, reclosable door for access to a medicine storing space within said chamber; B) a record card means for recording medical information thereon, said record card means having a surface arranged for writing thereon by erasable writing means for convenience in maintaining updated medical information thereon; C) a record holder means having two broad flat transparent faces defining a substantially rectangular space for removably holding therein at least one said record card means for recording medical information that is unobstructedly readable through said transparent faces; and D) connecting means for connecting said medicine holder to said record holder means so that said medicines and said medical information are carried together for optimal usage thereof, wherein the medicine storing spaces are outside of said rectangular space defined by said faces of said record holder means.

2. The combined holder according to claim 1, including marker holding means attached to said record holder means, said holding means adapted for removably holding erasable writing means.

3. The combined holder according to claim 1, in which said record holder means includes a hinge element along one of said sides for providing access to said rectangular space.

4. The combined holder according to claim 2, in which said surface arranged for writing is a rough, toothed, plastic surface adapted for writing upon with a graphite pencil.

5. The combined holder according to claim 1, in which said record card means is a plastic sheet folded in half with recess means for defining a space between folded halves of said sheet for receiving one or more sheets of indicia of the credit card and insurance card type.

6. The combined holder according to claim 5, in which said plastic folded sheet includes a tab means extending beyond said record holder means for opening said record holder means.

7. The combined holder according to claim 2, in which said surface arranged for writing is a smooth surface adapted for writing with a dry marker.

8. The combined holder according to claim 1, in which said closure means is a hinged door with latch.

9. The combined holder according to claim 5, in which said record card means has a first, transparent portion for reading said indicia and a second, opaque portion for reading information written thereon.

* * * * *